US011446922B2

(12) United States Patent
D'Annunzio

(10) Patent No.: US 11,446,922 B2
(45) Date of Patent: Sep. 20, 2022

(54) INKING SYSTEM WITH EMBEDDED COLOUR CORRECTION

(71) Applicant: BOBST FIRENZE S.R.L., Campi Bisenzio (IT)

(72) Inventor: Federico D'Annunzio, Florence (IT)

(73) Assignee: BOBST FIRENZE S.R.L., Campi Bisenzio (IT)

( * ) Notice: Subject to any disclaimer, the term of this patent is extended or adjusted under 35 U.S.C. 154(b) by 0 days.

(21) Appl. No.: 16/648,176

(22) PCT Filed: Sep. 21, 2018

(86) PCT No.: PCT/EP2018/025243
§ 371 (c)(1),
(2) Date: Mar. 17, 2020

(87) PCT Pub. No.: WO2019/057342
PCT Pub. Date: Mar. 28, 2019

(65) Prior Publication Data

US 2020/0276799 A1 Sep. 3, 2020

(30) Foreign Application Priority Data

Sep. 22, 2017 (EP) ..... 17020434

(51) Int. Cl.
*B41F 33/00* (2006.01)
*B41F 9/06* (2006.01)
*B41F 31/02* (2006.01)

(52) U.S. Cl.
CPC ..... *B41F 33/0045* (2013.01); *B41F 9/063* (2013.01); *B41F 31/022* (2013.01); *B41F 31/025* (2013.01)

(58) Field of Classification Search
CPC ..... B41F 31/025; B41F 5/24
See application file for complete search history.

(56) References Cited

U.S. PATENT DOCUMENTS 3,283,712 A * 11/1966 Chambon ..... B41F 31/025 101/350.4
5,003,877 A * 4/1991 Yano ..... B41F 31/025 101/363

(Continued)

FOREIGN PATENT DOCUMENTS

CN 101939167 A 1/2011
EP 0 739 729 A2 10/1996

(Continued)

OTHER PUBLICATIONS

International Search Report dated Nov. 12, 2018, in counterpart International Patent Application No. PCT/EP2018/025243 (5 pages).

*Primary Examiner* — Manish S Shah
*Assistant Examiner* — Leo T Hinze
(74) *Attorney, Agent, or Firm* — Bookoff McAndrews, PLLC

(57) ABSTRACT

The present invention concerns an inking for a flexographic or a rotogravure press. The inking system uses a very small amount of ink coupled with an ink source made of two tanks with two different inks. Thanks to feedback given by measuring the output directly on the printed support, the system mixes the ink in the optimal proportions to ensure an optimal printing quality at any time. It can compensate any effect due to environmental changes like the humidity or the temperature. This system, coupled with a seven colours press allows for the replacement of spot colours in most cases thereby saving times and costs.

20 Claims, 3 Drawing Sheets

(56) References Cited

U.S. PATENT DOCUMENTS

| | | | | |
|---|---|---|---|---|
| 5,355,799 | A * | 10/1994 | Lutz | B05C 1/0813 101/350.1 |
| 6,386,105 | B1 * | 5/2002 | Stahl | B41F 31/20 101/423 |
| 2011/0035040 | A1 * | 2/2011 | Ihme | B41F 31/005 700/103 |
| 2015/0021006 | A1 | 1/2015 | Vue et al. | |
| 2015/0210060 | A1 | 7/2015 | Shifley et al. | |

FOREIGN PATENT DOCUMENTS

| | | | |
|---|---|---|---|
| EP | 2985150 | A1 | 2/2017 |
| GB | 988559 | A | 4/1965 |
| GB | 1 432 677 | A | 4/1976 |
| GB | 1432677 | A | 4/1976 |
| JP | S5894467 | A | 6/1983 |
| JP | S5993351 | A | 5/1984 |
| WO | 2009071133 | A1 | 6/2009 |

* cited by examiner

INKING SYSTEM WITH EMBEDDED COLOUR CORRECTION

CROSS-REFERENCE TO RELATED APPLICATION(S)

This application is a National Stage under 35 U.S.C. § 371 of International Application No. PCT/EP2018/025243, filed on Sep. 21, 2018, which claims priority to European Patent Application No. 17020434.1, filed Sep. 22, 2017, the contents of all of which are incorporated by reference in their entirety.

FIELD OF THE INVENTION

The present invention concerns a system for the on-board ink management, mainly directed to flexographic or rotogravure printing machines. The system according to the invention achieves the feeding of the ink in an ink supplying module of the printing machine and also controls the adjustment of the printing parameters.

TECHNICAL BACKGROUND

A common rotogravure printing unit is made of a gravure cylinder (or printing cylinder) in contact with a second cylinder, which is usually a rubber cylinder, also called the impression roller. The gravure cylinder exhibits a collection of tiny cells on its surface whose distribution defines the image to be printed. These cells are filled with ink which is transferred onto a printing support by contact. The support (paper, cardboard or polymer film) is sandwiched between the printing cylinder and the impression roller.

A common flexographic printing unit is made of an anilox cylinder, which transfers the ink to a cliché carrying cylinder (or printing cylinder) which in turn is in contact with the impression roller. The printing support is, like in the rotogravure case, sandwiched between the printing cylinder and the impression roller. The anilox cylinder is made of tiny cells on its surface whose function is to carry the ink to the printing cylinder.

An inking system is used to fill the cells of an etched cylinder with ink, the etched cylinder being the gravure cylinder of a rotogravure printing unit or the anilox of a flexographic printing unit. A common inking system uses an inking roller (or inking cylinder) to fill the cells, which partially or totally dips into a pan filled with ink, rolls against the etched cylinder and provides the necessary pressure to fill the cells completely. During printing, a doctor blade removes the excess of ink from the surface of the etched cylinder while leaving the ink inside the cells.

In the currently known printing machines of the type as just described, a problem arises when replacing the ink in the machine with a different one. Also, current machines suffer from drifts in image quality due to variation of speed of the printing machines, due to the drying of the ink in the ink pan or due to environmental variations (pressure, humidity, temperature). Embedded systems are provided for taking care of a controlled replacement of the ink, at the same time cleaning the tank and the ducts.

These mentioned known systems are then directed to supply the printing units with an ink having a predetermined desired quality (as far its nature or colour are concerned).

In flexographic and rotogravure printing machines a standard printing process was recently developed making use of seven ink colours (besides white). With this standard a wide range of printed colours can be obtained, capable of covering about 90-95% of the colours coded under the PMS (Pantone® Matching System) by using only said seven colours. Such a standard overcomes the old concept of having a specific ink for each special colour, and thus the necessity to replace the ink in the machine to change the printed colour in most cases. By special colour we mean the "spot" colours used traditionally for consistent branding and logos, smooth coverage of large areas or colours outside the gamut of the traditional CMYK printing systems.

However, a seriously felt drawback, particularly in flexographic printing machines, is that when the printing speed increases (i.e. when the rotation speed of the printing rollers increases), the effectiveness of the transfer of the ink to the printing support is affected, resulting eventually in a drop of the print quality. In particular, as the quality of the ink transfer varies, there is a rampant and difficult to predict decay of the printing parameters, in terms e.g. of printing density and colorimetric parameters (usually measured in the Lab colour space). This phenomenon affects the colours constructed by halftoning several inks together in a much more severe way than it affects the spot colours obtained from a single special ink.

EP 2,985,150 discloses a system that corrects the ink composition in a press based on the result of a measurement of the printed support. The inking system uses two sets of ink and two mixing systems. Each mixing system has a plurality of ink sources. The first set is used to produce the base ink, the second set (and second mixer) is used to correct the base ink based on the measurement of a printed patch. The system is complex and has a long reaction time due to the large amount of ink in the system. The system lacks the elements to correct the printed output promptly: It can only add ink. Also, the corrected ink is not in direct contact with the printing roller (it is presented as an ink dispensing unit), and thus, it has to wait until the former ink is consumed before the corrected ink is used. In addition, to control the temperature, the whole volume of ink is heated, which takes time. Also, the system cannot be used to cool the ink if the temperature happens to be temporarily too high.

US 2015/0210060 discloses an inking system with a recirculation circuit which compensates for the evaporation of the solvent in real time. The system is meant to be refilled with ink at the end of each printing job and is not suitable for an in-line adaptation of the printing parameters.

SUMMARY OF THE INVENTION

The invention addresses the problem of changing ink, and the problem of printing quality affected by the printing speed, or by other external parameters.

According to the invention, these aims are achieved by the invention defined in the claims.

In particular, this invention implements a colour correction scheme, using a minimal amount of ink in the inking system to make the system reactive (in time) and also provides the possibility to quickly replace completely the ink present in the inking system.

The invention is implemented by containing most the ink used for inking in the little space close to the contact line between the inking cylinder and the etched cylinder, which we call the nip area.

Advantageously, the invention implements the possibility to quickly empty the nip area and replace its content with new ink.

Advantageously, the invention provides an ink source with two or more ink tanks containing ink with different characteristics. The ink is extracted from each tank in configurable amounts and mixed together before reaching the nip area. In this way, the ink characteristics can be adjusted in real time to achieve the desired printing specifications, thereby compensating the influence of external parameters or printer speed.

DETAILED DESCRIPTION OF THE INVENTION AND OF SOME OF ITS EMBODIMENTS

Figure 1:
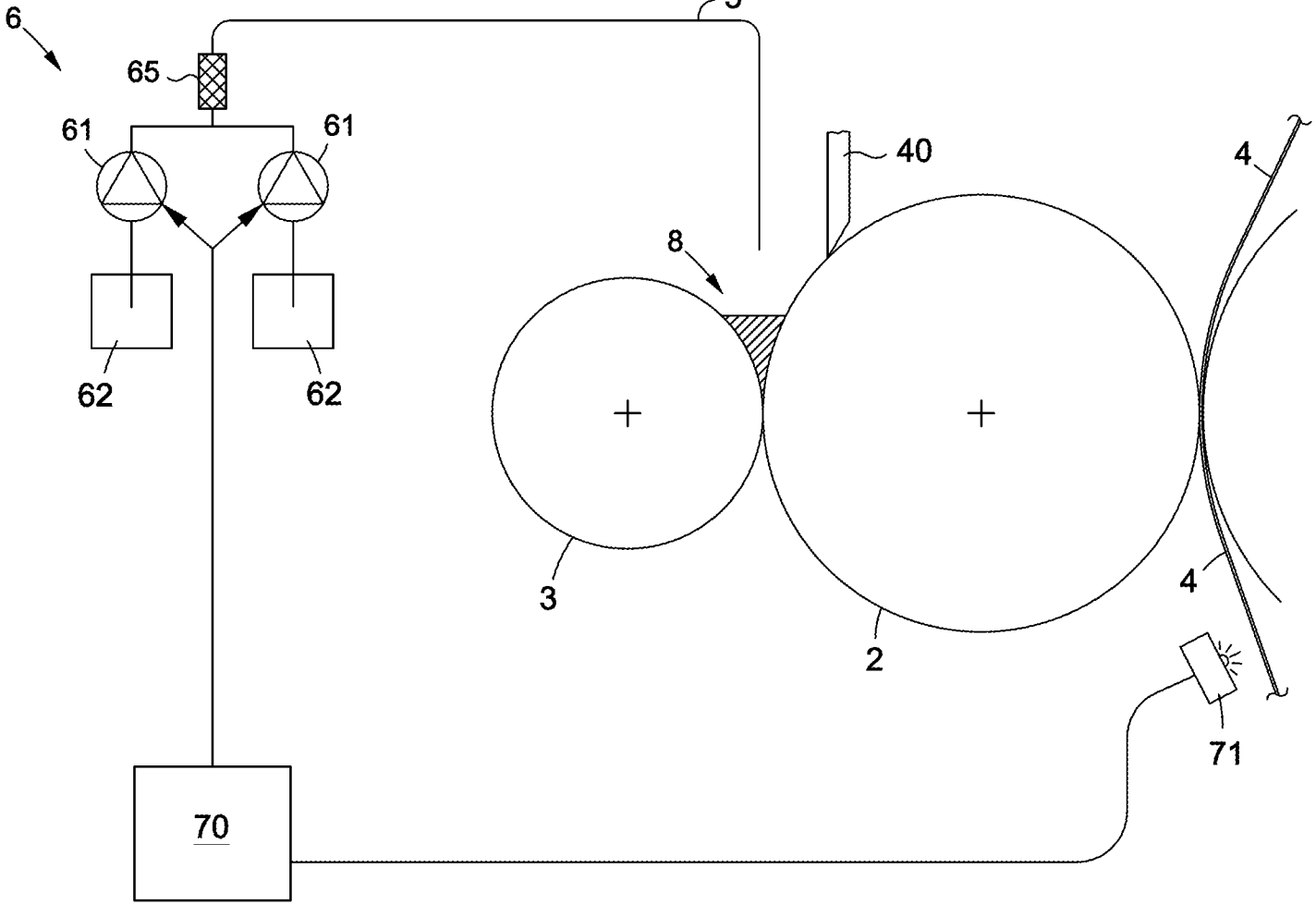
FIG. 1 shows a sketch showing the principle of the invention on a rotary printing machine.

FIG. 1 shows the principle of implementation of the invention. The inking cylinder 3 is in contact with the etched cylinder 2. A nip area 8 is formed between the two cylinders (2,3) and is configured to contain the ink 10. The ink is brought through an ink outlet 5 that drops the ink directly on the inking cylinder 2 or directly into the nip area 8 (or directly on the etched cylinder). Fundamentally, the ink outlet is configured to drop the ink in a location where the ink ends up in the nip area 8, without going through an ink buffer that would unnecessarily increase the amount of ink in the system, and thereby impair its reactivity (Said ink buffer may be an ink pan or an ink chamber with a double doctor blade). The ink is extracted in a controllable amount from two ink tanks 62, using preferably two pumps 61. Alternatively, the ink can also be extracted using a single pump and a valve which selects the source tank 62 (alternative not shown in the figures). Advantageously, the ink level in the nip area 8 is kept as low as possible while ensuring an optimal print quality. A sensor 71 is used to record the print parameters on the printing support 4 that comes out of the printing unit. The sensor 71 is functionally connected to control means 70 that can compare the sensor 71 reading with a predefined (target) value issued from the print specifications.

Advantageously, a sensor 74 monitors the ink level in the nip 8 to ensure a proper inking of the etched cylinder while the printing machine is consuming ink. The control system 70 is functionally connected to the sensor 74 and configured to control the ink level in the nip area. For example the control system 70 can be configured to maintain the ink level between two predefined values. In this way, the total amount of ink in the inking system can be kept to a minimal value, while providing a good print quality.

Advantageously, the inking cylinder rotates according to the direction 31 and the etched cylinder rotates according to direction 21. Thus the inking cylinder 3 is configured to rotate in the direction suitable for carrying ink through the nip area 8 toward the etched cylinder 2. In this configuration, ink can be dropped from the ink outlet 5 onto the inking cylinder, and the inking cylinder 3 will bring the ink into the nip area 8.

Figure 3:
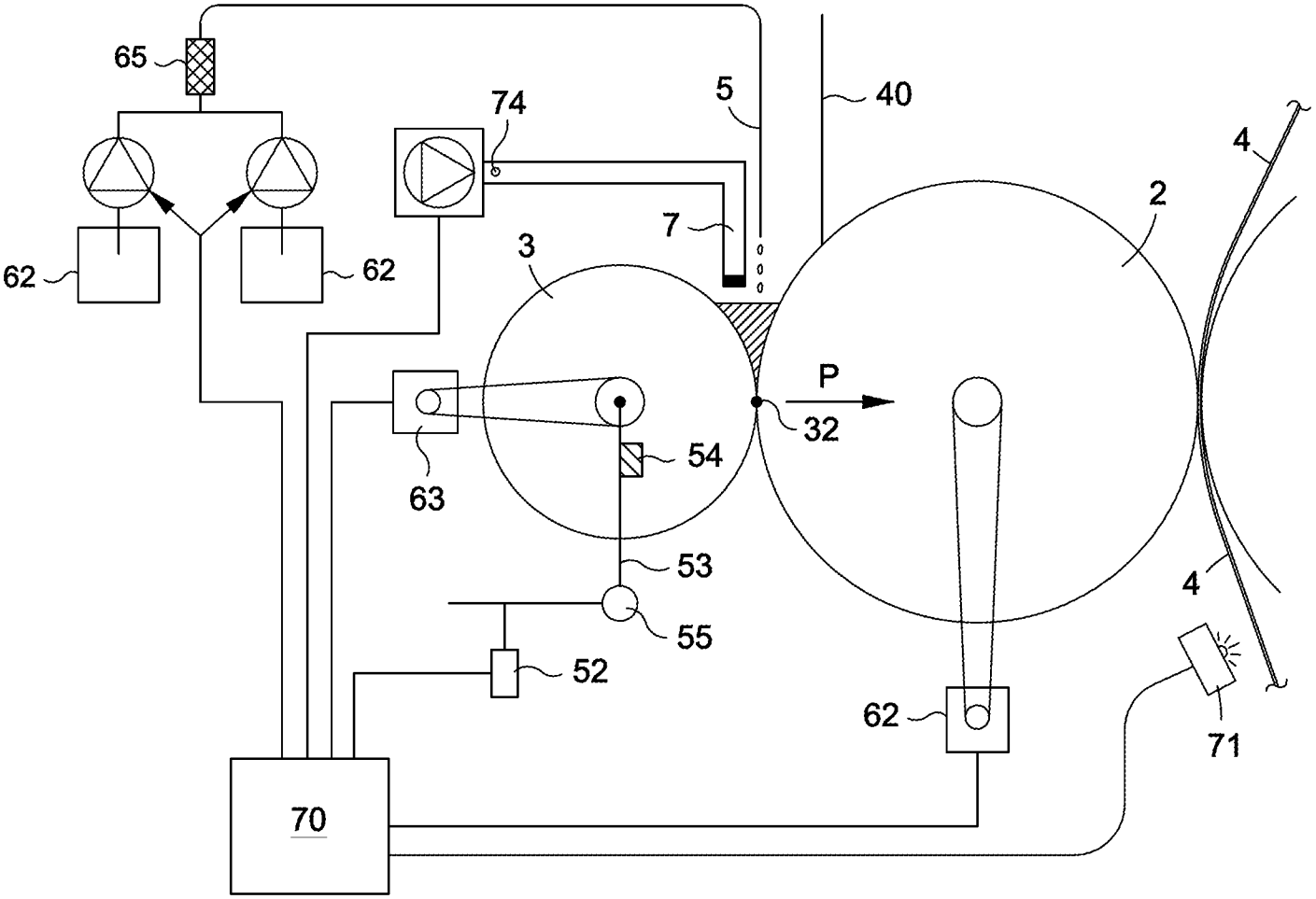
FIG. 3 shows the inking cylinder in contact with the etched cylinder under normal printing conditions.

A doctor blade 40 is positioned above the nip area 8 on the etched cylinder to remove the ink excess from the etched cylinder surface and put the ink back into the nip area 8. The inking cylinder rotation is controlled by a motor 63, functionally connected to the control means 70, as shown in FIG. 3. The inking cylinder 3 may also be controlled by a gearing system connected to the etched cylinder 2, thereby defining a constant speed ratio between said cylinders when printing.

The nip area 8 is defined as the volume between the inking cylinder 3 and the etched cylinder 2 in the vicinity of the contact line 32 where it is possible to retain ink by the sole use of said cylinders (and some side walls), and where ink is present when the printing machine is running. The contact line 32 is the generatrix of the etched cylinder 2 that is in contact with the inking cylinder 3 while the printing unit is running.

The inking device 6 is configured to extract ink from the ink tanks 62 using the pump(s) 61. The ink is passed in the mixer 65 to make sure the resulting mixtures is uniform (i.e. well mixed). The resulting ink mixture is delivered to the nip area 8 through the ink outlet 5.

A common implementation of the inking device 6 uses two ink tanks 62. The first tank contains ink with a low pigment density, and the second tank contains ink with a higher pigment density. In this configuration, the ink provided by the inking system 6 can range from the low ink density of the first tank to the high density of the second tank, depending on the relative amounts chosen for the mixture. The higher the difference in density between the two tanks, the larger the range of possible ink mixtures, but the less accurate the value of pigment density in the resulting mixture. In an extreme case, one can choose a tank with a high pigment density and one with only clear ink. Technically, clear ink is nothing but the solvent used in inks without any pigments.

The control means 70 comprise an electronic controller to which a sensor 71 is logically connected, for detecting the printing parameters directly on the printing support 4. The printing parameter may comprise the Lab colorimetric parameters and density, or the reflection spectrum, or the ink coverage, or any combination of these parameters. The sensor 71 can be for example a spectrophotometer, a colour camera, or a high-resolution camera. The spectrophotometer measures the spectrum (from which the Lab colorimetric parameters and density can be extracted), the colour camera measures density and Lab colorimetric parameters, and the high-resolution camera can measure, in addition to colour and density, the ink coverage, i.e. the percentage of the support area covered by the individual halftone dots.

When, via the sensor 71, a printing parameter measurement does not match a predefined target value, the electronic controller 7 activates the inking device 6 so as to draw the desired amount of ink from each tank 62 and deliver it to the nip area 8. Based on the sensor reading and on the knowledge of the ink mixture used for printing, the computation means are configured to compute the corrected mixture required to obtain the predefined target printing parameter values. There are several alternatives to correct the ink characteristics present in the nip area 8 to make sure that the ink reaching the support has the characteristics of the corrected mixture.

One alternative consists in delivering the corrected mixture of ink to the nip area 8. The delivered ink will mix with the one already present in the nip area 8, and once enough ink is consumed by the system, the ink characteristics in the nip area will eventually reach the properties of the corrected ink mixture. This procedure is recommended if the mismatch between the target values of the printing characteristics and the one measured by the sensor 71 is small. For example when the mismatch is still within the printing specifications.

Another alternative, which is faster than the previous one, consists of delivering a mixture of ink whose composition and whose amount is computed such that, when mixed with the one present in the nip, results in the corrected ink mixture. It implies the use of a sensor 7 to monitor the ink level in the nip area 8, to know the volume of ink present in the nip area 8 to perform the computation. Also, thanks to the natural motion of the ink in the nip area, caused by the rotation of the inking cylinder 3 and the etched cylinder 4, the added ink gets mixed quickly with the one already present in the nip area 8. Nevertheless, this method presents a risk that the ink reaching the support has a composition of the one added (or close to the one added), in a transition phase before the complete mixing of the ink present in the nip area 8 with the one added.

To know the volume of ink present in the nip area 8 in the alternative described in the previous paragraph, several alternatives are possible. One Alternative consists in computing the volume of ink based on the sensor reading (and on the inking cylinder or etched cylinder length). This method is complex because it requires a carful calibration to relate ink level to ink volume, because the air-ink interface tends to be convex, and the shape of this interface tends to vary with ink viscosity and printing speed. Since the sensor 7 is used to maintain the ink level between two boundaries, the amount of ink is fairly stable. As a consequence, a much simpler alternative assumes that there is a fixed and known amount of ink (which linearly depends on the inking/etched cylinder length) in the nip area 8. Optionally, this amount of ink may be a function of the printing speed. The amount of ink can be measured once during a calibration phase of the printer model line.

Another alternative to correct the ink characteristics present in the nip area 8, even faster and without presenting the risk of the previous alternative, consists of replacing the ink of the nip area 8. The electronic controller 70 activates the ink replacement procedure by opening the gap between the inking cylinder and the etched cylinder, removing the ink in the nip area 8, closing the gap and refilling the ink area with the corrected ink mixture (without using any solvent for cleaning). The ink replacement procedure results in a faster correction of the printing parameters, thereby reducing the waste of support (that is, the support that must be discarded because it was printed out of specifications), but causing some waste of ink. The discarded ink may be collected by an ad hoc system and reused later on. Thanks to the rotation of the inking cylinder, which pushes the ink through the gap, this ink removal car be performed very quickly (for example in less than one or two seconds). Please note that we do not use solvent thanks to the fact that the optical characteristics of the corrected ink are very similar than the ones present prior to its removal, since they would be identical in the absence of environmental perturbations. Thus, if there are residues from the former ink still present, it is not an issue. The situation is different when completely changing the colour of the ink. Also, if there was some solvent residue after a cleaning with a solvent, it would affect the resulting colour significantly; Thus the need to wait until the rollers are dry if using solvent.

Please note that in any above mentioned alternative for correcting the ink characteristics, it is advantageous to have the least possible amount of ink in the inking system (for being more reactive, and wasting less ink). This can, for example, be performed by using a single inking system using the nip area 8 (and avoiding an additional—traditional—ink pan, or a reservoir with a double doctor blade). By using a single inking system that uses the nip area 8, the total amount of ink in the inking system can be easily lower than 500 g per meter of etched cylinder width, is typically lower than 250 g per meter of etched cylinder width, is reasonably around 80 g per meter of etched cylinder width (or smaller than 120 g per meter of etched cylinder width) and can be as low as 40 g per meter of etched cylinder width when having optimal ink characteristics.

By total amount of ink in the inking system, we mean the total amount of ink passed the point where the ink is not easily removed without creating waste, or not easily replaced by a new one. It is the amount of ink that must be consumed by the printing system (or discarded) before being replaced by ink with corrected (or different) characteristics. Here, it includes the ink mixer 65, the ink outlet 5 and the ink in the nip area. It excludes the ink tank 62, because, the ink tank is designed to be replaced, and the ink inside the tank can be easily reused (It also excludes the ink conduct between the reservoir and the mixer since the point where ink with corrected characteristics is input to the system if the input to the mixer 65, thus the total amount of ink in the inking system is the total amount of ink passed this point). In a more traditional inking system using an ink pan or an ink chamber with a double doctor blade, the ink in the pan or in the double doctor blade chamber is part of the total amount of ink in the inking system, since it is not easy to remove and replace this ink (without waste) with new ink.

Another implementation of the invention is used to change the ink characteristics (instead of just correcting it). This change of ink characteristics can be advantageously applied in the eights or ninth printing unit of a seven colour printing system, or to implement a spot colour in a more traditional printing machine. The change of ink characteristics is implemented by using more than two inks with different colours. Since the system uses little ink in the inking nip 8, the invention can be used as a replacement of an ink kitchen. For example, four ink buckets 62 can be used, with an additional fifth bucket 62 containing clear ink. In this way, a spot colour can be created by drawing ink and clear ink from the tanks in well-defined relative amounts to reach the desired spot colour characteristics. Of course, one can use an arbitrary number of ink buckets (at least 3, to cover a three-dimensional colour space) to implement this embodiment. This embodiment is also particularly interesting if the printing unit is equipped with a system to flush the ink from the inking nip. In the latter case, the bucket 62 filled with clear ink (or an additional one filled with a cleaning solvent) and its corresponding pump are used to clean the ink outlet 5, while the flushing process is activated.

Figure 2:
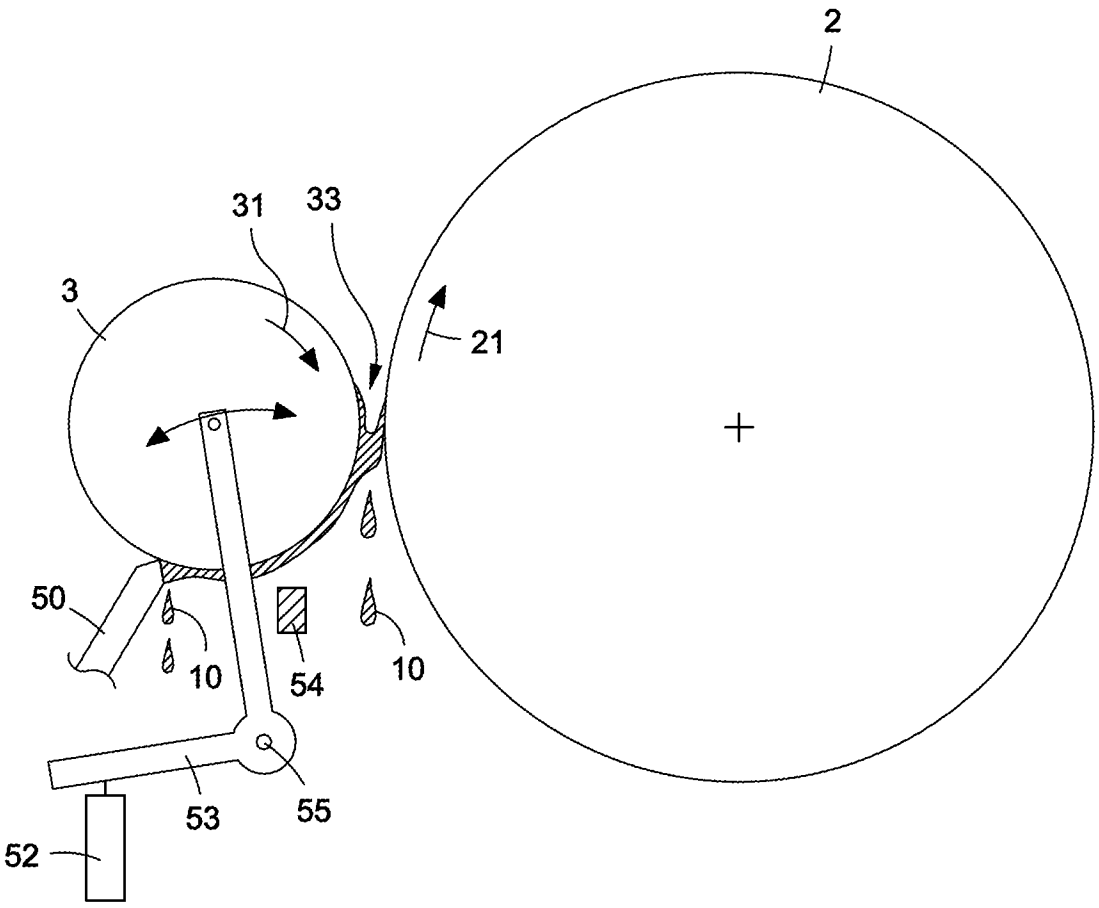
FIG. 2 shows the inking cylinder creating a gap with the etched cylinder to empty the nip area from its ink.

To create a gap 33 between the inking cylinder 3 and the etched cylinder 2, the inking cylinder may be mounted on a structure 53 which is mounted on a pivoting axis 55 on the printing machine frame. A piston is used to push the structure 53 against an abutment 54. The abutment is adjustable to set the precise distance between the two cylinders (2,3) when the machine is running. To open the gap 33, the piston 52 is opened, as depicted in FIG. 2, which causes the ink to drip between the two cylinders. An ad-hoc bucket may be used to collect the dripped ink (not shown). Also, a blade 50 may be used to prevent the ink from circulating around the inking cylinder 3. This blade 50 is advantageously configured on a retractable axis, to be able to engage and disengage with the inking cylinder 3. Setting the blade 50 out of contact with the inking cylinder (i.e. dis-engaging) when the printing machine operates in normal condition lowers the wearing of the inking cylinder 3. Alternatively, instead of using a blade, one could use a polygonal rotating roller like the one used patent U.S. Pat. No. 5,181,470, against the inking cylinder.

Advantageously, a source of compressed air can be provided to clean the ink outlet 5. The source may be connected, through a valve, prior to the mixer 65. In this way, the ink outlet 5 and the mixer 65 are emptied and ready for the next printing job. The air is advantageously used after that solvent is used to clean the mixer and the outlet.

To further control the printing parameters, the computation means 70 may be functionally connected to an inductive heating device placed in proximity to the etched cylinder 2. The inductive device is used to heat the etched cylinder surface, which causes the heating of the ink transported by the etched cylinder. Heat allows controlling the ink viscosity. In general, the more heat, the less viscous the ink. A more fluid ink tends to transfer better on the printing support, and thus, has an influence on the print density. In general, the heating is controlled such that the ink reached the printing support with a predefined temperature. Optionally, this parameter may be used to adjust the printing parameters. For example, the computation means can be configured to increase slightly the print density by heating the ink slightly over the predefined value. preferably, a temperature sensor is used to measure the etched cylinder temperature. The temperature sensor can, for example, be a pyrometer.

Please note that a printing unit is a part of a printing machine whose function is to print a single colour of a printing job. For example, there might be a printing unit for printing yellow, another for printing black, etc. There exist also printing units that are printing gloss. The final print is obtained by passing the support/paper/web through several printing units in the printing machine.

The invention claimed is:

1. An inking system for a rotary printing unit and for the adjustment of printing parameters, the rotary printing unit being configured to print on a printing support, the inking system comprising:

an inking cylinder and an etched cylinder arranged to retain ink between them in a nip area and configured to turn in a same direction;

a doctor blade having a lowest end positioned on the etched cylinder above ink in the nip area to remove excess ink from a top surface of the etched cylinder;

an ink source comprising two tanks for storing ink and suitable for drawing ink from the two tanks in configurable amounts;

a sensor configured to obtain a measured value of the printing parameters on the printing support;

control means adapted to compare the measured value of the printing parameters with a target value;

wherein the ink source is configured to be operatively connected to the control means whereby, when the measured value of the printing parameters differs from the target value, the ink source is activated by the control means to provide ink from the two tanks in corrected relative amounts to the nip area.

2. The inking system according to claim 1, further comprising an ink outlet configured to drop ink directly on the inking cylinder or directly into the nip area.

3. The inking system according to claim 1, further comprising a second sensor configured to measure the level of the ink in the nip area, and wherein the control system is functionally connected to the second sensor.

4. The inking system according to claim 1, wherein the inking cylinder is configured to rotate in a direction suitable for carrying ink through the nip area toward the etched cylinder.

5. The inking system according to claim 1, wherein the nip area is located between the doctor blade and a contact line between the etched cylinder and the inking cylinder.

6. The inking system of claim 1, wherein the etched cylinder includes cells configured to be filled with ink from the inking cylinder.

7. The inking system of claim 6, wherein the doctor blade is configured to remove excess ink from the etched cylinder while leaving ink inside of the cells.

8. A method for supplying ink for an inking system for a rotary printing unit configured to print on a printing support, the inking system including an inking cylinder and an etched cylinder arranged to retain ink between them in a nip area, the method comprising:

rotating the inking cylinder and the etched cylinder in a same rotational direction;

measuring at least one printing characteristic on the printing support at the output of the printing unit using a sensor; and when the measured at least one printing characteristic does not match a target predefined value, computing a corrected mixture of ink and drawing the corrected mixture from an ink source, and delivering said corrected mixture to the nip area between the etched cylinder and the inking cylinder.

9. The method according to claim 8, wherein the corrected mixture is poured directly into the nip area or directly onto the inking cylinder.

10. The method according to claim 8, wherein the ink in the nip area is removed prior to delivering the corrected mixture to the nip area by moving the inking cylinder away from the etched cylinder to create a gap between the inking cylinder and the etched cylinder;

rotating the inking cylinder to remove ink from the nip area;

setting the inking cylinder back in contact with the etched cylinder.

11. The method according to claim 10, wherein the removing of the ink from the nip area is performed in a solventless manner.

12. The method according to claim 10, wherein the removing of the ink from the nip area is performed in less than two seconds.

13. The method according to claim 10, wherein, when the gap is created between the inking cylinder and the etched cylinder, a blade is used to contact the inking cylinder in order to prevent the ink from looping around the inking cylinder.

14. The method according to claim 8, wherein a total amount of ink mixture in the nip area is measured by a second sensor and maintained to a level that does not exceed 500 grams per meter of etched cylinder width.

15. The method according to claim 8, further comprising:

removing excess ink from the etched cylinder using a doctor blade having a lowest end positioned above ink in the nip area.

16. An inking system for a rotary printing unit and for adjustment of printing parameters, the rotary printing unit being configured to print on a printing support, the inking system comprising:

an inking cylinder and an etched cylinder arranged to retain ink in a nip area, the nip area being defined as a volume between the inking cylinder and the etched cylinder in a vicinity of a contact point of the inking cylinder and the etched cylinder, the inking cylinder and the etched cylinder turning in a same rotation direction;

an ink source comprising two tanks for storing ink and suitable for drawing ink from the two tanks in configurable amounts;

a sensor configured to obtain a measured value of the printing parameters on the printing support; and a control system configured to:

compare the measured value of the printing parameters with a target value;

determine a volume of ink present in the nip area based on a printing speed;

and when the measured value of the printing parameters differs from the target value, control the ink source to provide ink from the two tanks in corrected relative amounts directly to the volume of ink in the nip area between the inking cylinder and the etched cylinder, wherein the corrected relative amounts of ink are based on the determined volume based on the printing speed.

17. The inking system of claim 16, wherein, to control the ink source to provide the ink from the two tanks in the corrected relative amounts, the control system is further configured to:

when the measured value of the printing parameters differs from the target value by an amount that is still within printing specifications, control the ink source to provide the ink from the two tanks in the corrected relative amounts so that delivered corrected relative amounts mix with ink already present in the nip area and, once enough ink is consumed, ink characteristics in the nip area eventually reach properties of a corrected ink mixture.

18. The inking system of claim 16, wherein the sensor is a first sensor, the inking system further includes a second sensor to monitor an ink level in the nip area, wherein the control system is configured to determine the volume of ink present in the nip area based on the monitored ink level, and, to control the ink source to provide the ink from the two tanks in the corrected relative amounts, the control system is further configured to:

compute the corrected relative amounts based on the determined volume of the ink present in the nip area, and control the ink source to provide the ink from the two tanks in the corrected relative amounts so that, when the corrected relative amounts are mixed with the ink present in the nip area, a corrected ink mixture is obtained.

19. The inking system of claim 16, wherein, to control the ink source to provide the ink from the two tanks in the corrected relative amounts, the control system is further configured to:

open a gap between the inking cylinder and the etched cylinder, remove ink present in the nip area, close the gap, and control the ink source to provide the ink from the two tanks in the corrected relative amounts to obtain a corrected ink mixture.

20. The inking system of claim 19, further comprising:

a structure to mount the inking cylinder;

a pivoting axis to mount the structure, the pivoting axis being on the rotary printing unit; and a piston configured to move the structure, wherein, to open or close the gap, the control system is further configured to: control the piston to open or close, thereby moving the inking cylinder by movement of the structure about the pivoting axis.

* * * * *